US011021921B2

(12) United States Patent
Patton

(10) Patent No.: US 11,021,921 B2
(45) Date of Patent: Jun. 1, 2021

(54) MORPHABLE ANCHOR

(71) Applicant: SCHLUMBERGER TECHNOLOGY CORPORATION, Sugar Land, TX (US)

(72) Inventor: Damien Gerard Patton, Huntly (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/557,269

(22) Filed: Aug. 30, 2019

(65) Prior Publication Data

US 2019/0383111 A1 Dec. 19, 2019

Related U.S. Application Data

(62) Division of application No. 14/697,851, filed on Apr. 28, 2015, now Pat. No. 10,400,529.

(30) Foreign Application Priority Data

May 2, 2014 (GB) ..... 1407746.5

(51) Int. Cl.
*E21B 23/01* (2006.01)
*E21B 23/04* (2006.01)
*E21B 43/10* (2006.01)

(52) U.S. Cl.
CPC ..... *E21B 23/01* (2013.01); *E21B 23/04* (2013.01); *E21B 43/103* (2013.01)

(58) Field of Classification Search
CPC ..... E21B 43/103; E21B 43/108; E21B 23/04
See application file for complete search history.

(56) References Cited

U.S. PATENT DOCUMENTS 1,547,025 A 7/1925 Callahan
3,977,473 A 8/1976 Page, Jr.
(Continued)

FOREIGN PATENT DOCUMENTS

GB 2266908 A 11/1993
GB 2398312 A 8/2004
(Continued)

OTHER PUBLICATIONS

First Examination Report received in GCC Patent Application No. 2015/09339 dated Nov. 29, 2017, 4 pages.
(Continued)

*Primary Examiner* — Steven A Macdonald
(74) *Attorney, Agent, or Firm* — Kelly McKinney

(57) ABSTRACT

A method of anchoring a morphable tubular in a wellbore includes providing a first tubular member including an expandable portion having an anchoring system arranged around a circumference thereof, the anchoring system including a gripper element, two wedge elements having inclined surfaces oriented to engage two oppositely arranged inclined surfaces of the gripper element, wherein each wedge element includes a beam spring, which are oppositely arranged to act against the inclined surfaces of the gripper element, locating the expandable portion in an existing tubular in a wellbore, introducing fluid pressure to an inner surface of the expandable portion and morphing the expandable portion towards the existing tubing so that the gripper element engages an inner surface of the existing tubing, reducing the fluid pressure, and maintaining engagement of the gripper element on the inner surface by action of the at least one beam spring axially on the gripper element.

11 Claims, 4 Drawing Sheets

(56) References Cited

U.S. PATENT DOCUMENTS

| | | | |
|---|---|---|---|
| 5,220,959 | A | 6/1993 | Vance, Sr. |
| 6,467,540 | B1 | 10/2002 | Weinig et al. |
| 8,678,083 | B2 | 3/2014 | Xu |
| 9,840,878 | B2 | 12/2017 | Martin et al. |
| 10,400,529 | B2 | 9/2019 | Patton |
| 2003/0205386 | A1 | 11/2003 | Johnston et al. |
| 2004/0182583 | A1 | 9/2004 | Doane et al. |
| 2004/0244994 | A1 | 12/2004 | Jackson et al. |
| 2007/0000664 | A1 | 1/2007 | Ring et al. |
| 2011/0038742 | A1 | 2/2011 | Fleig et al. |
| 2012/0205873 | A1 | 8/2012 | Turley |
| 2012/0273236 | A1 | 11/2012 | Gandikota et al. |
| 2015/0198005 | A1 | 7/2015 | Delzell et al. |
| 2015/0315864 | A1 | 11/2015 | Patton |
| 2015/0345249 | A1 | 12/2015 | Gorrara et al. |
| 2016/0047176 | A1 | 2/2016 | Martin |
| 2016/0076324 | A1 | 3/2016 | Allen et al. |
| 2016/0090801 | A1 | 3/2016 | Hazelip et al. |

FOREIGN PATENT DOCUMENTS

| | | | |
|---|---|---|---|
| GB | 2512506 | A | 10/2014 |
| WO | 2005121498 | A1 | 12/2005 |
| WO | 2007119052 | A1 | 10/2007 |
| WO | 2012127229 | A2 | 9/2012 |
| WO | 2014006373 | A2 | 1/2014 |
| WO | 2020251940 | A1 | 12/2020 |

OTHER PUBLICATIONS

Second Examination Report received in GCC Patent Application No. 2015/09339 dated May 31, 2018, 3 pages.

Combined Search and Examination Report received in GB Patent Application No. GB1407746.5 dated Aug. 22, 2014, 4 pages.

Office Action received in European Patent Application No. 15726243.7 dated Jan. 27, 2020, 6 pages.

International Search Report and Written Opinion of International Patent Application No. PCT/GB2015/051270 dated Oct. 28, 2015, 11 pages.

International Preliminary Report on Patentability of International Patent Application No. PCT/GB2015/051270 dated Nov. 8, 2016, 8 pages.

Office Action received in the BR Application BR112016025643-3, dated Jul. 12, 2020 (8 pages).

International Search Report and Written Opinion of International Patent Application No. PCT/US2020/036803 dated Sep. 21, 2020 (14 pages).

MORPHABLE ANCHOR

CROSS-REFERENCE TO RELATED APPLICATIONS

This application is a divisional of U.S. Patent Application Publication No. 2015/0315864, filed Apr. 28, 2015, which claims priority to GB Patent Application No. 1407746.5, filed May 2, 2014.

BACKGROUND

The present invention relates to an apparatus and method for securing a tubular within another tubular, creating a seal across an annulus in a wellbore, and centralizing or anchoring tubing within a wellbore. In particular, though not exclusively, the invention relates to an apparatus and method for anchoring a morphable tubular in a wellbore.

Oil and gas wells are completed by forming a borehole in the earth and then lining the borehole with a steel casing to form a wellbore. Typically, a number of sections of casing are used. A first section of casing is lowered into the wellbore and hung from the surface after the well has been drilled to a first designated depth. Cement is then circulated in the annulus between the outer wall of the casing and the borehole. The well is then drilled to a second designated depth and a second section of casing having a smaller diameter is run into the well. The second section may either be "hung off" in a well head at surface or is set at a depth such that the upper portion of the second section overlaps the lower portion of the first section of casing. If, in this second example, the casing does not extend to surface then the casing is referred to as a liner. The liner section is then fixed to the first section, such as by using a liner hanger. The second casing section or liner is then cemented. This process is typically repeated with additional casing sections of decreasing diameter until the well has been drilled to the total required depth. The liner hanger usually has the ability to receive a tie back tool for connecting the liner with a string of casing which extends from the liner hanger back to the surface.

As each liner is set within a previously set liner, it is desirable to have the inside diameter of each liner be as large as possible to provide the maximum available space to insert more liners and leave a throughbore of sufficient diameter to operate and produce the well. Consequently the annulus between the outer surface of the liner hanger and the inner surface of the previously set casing or liner is kept as narrow as possible.

In order to achieve the maximum inside diameter, techniques have been developed where a liner is set in a wellbore by creating a metal to metal seal directly between the liner and the previously set casing or liner using an expander tool which is run through the member. The expander tool typically has a forward cone with a body whose diameter is sized to that of the previous casing or liner. These so-called expandables have an internal surface which, when expanded, is cylindrical and matches the profile of the expander tool.

The present applicants have developed a technology where a tubular metal portion is forced radially outwardly by the use of fluid pressure acting directly on the portion. Sufficient hydraulic fluid pressure is applied to move the tubular metal portion radially outwards and cause the tubular metal portion to morph itself onto a generally cylindrical structure in which it is located. The portion undergoes plastic deformation and, if morphed to a generally cylindrical metal structure, the metal structure will undergo elastic deformation to expand by a small percentage as contact is made. When the pressure is released the metal structure returns to its original dimensions and will create a seal against the plastically deformed tubular metal portion. During the morphing process, both the inner and outer surfaces of the tubular metal portion will take up the shape of the surface of the wall of the cylindrical structure. This morphed tubular is therefore ideally suited for creating a seal between a liner and previously set casing or liner which is worn and presents an irregular internal surface. WO2007/119052 and WO2012/127229, both to the present Applicants, show liner hanger assemblies based on morphing one tubular within another.

When a tubular is morphed or expanded into another tubular in a liner hanger assembly, a large axial load is placed on the connection. To assist in supporting this load, it is known to profile the outer surface of the liner such as by knurling to provide a larger contact area and improve the grip.

WO2014/006373 to the present Applicant's discloses the use of reinforcing annular members located on the outside of the liner which define expandable portion annular regions having differing resistance to the radial load whereby the regions having lower resistance expand prior to the regions having greater resistance when the expandable portion is subjected to radial outward expansion during morphing. In an embodiment, gripper elements are located in recesses between annular members. The gripper element comprises a ring formed from a plurality of gripping pads which are configured to resist axial and/or rotational movement of the liner by gripping an inner surface of the existing casing or liner. During application of fluid pressure to cause morphing, the gripper elements are forced radially outwardly against the inner surface of the outer tubular. Thus an anchor is effectively created by the gripping bands to assist in carrying the load of the liner while creating a metal to metal seal between the liner and the existing casing or liner.

US2012/0273236 to Gandikota et al discloses an anchor device based on expandable tubing in which bow springs are used to anchor a liner to casing or a wellbore. Bands are arranged parallel to the longitudinal axis on an outer surface of the expandable tubular. Each band is attached to the tubular at a first connection point and a second connection point, wherein each band is configured to bow radially outward as the expandable tubular shortens in length in response to the expansion of the tubular.

SUMMARY

A method of anchoring a morphable tubular in a wellbore according to one or more embodiments of the present disclosure includes providing a first tubular member including an expandable portion, the expandable portion having an anchoring system arranged around a circumference thereof, the anchoring system including a gripper element having first and second oppositely arranged inclined surfaces, first and second wedge elements having third and fourth inclined surfaces oriented to engage the first and second oppositely arranged inclined surfaces, respectively, to move the gripper element to a radially extended position as the third and fourth inclined surfaces are moved against the first and second oppositely arranged inclined surfaces, wherein each of the first and second wedge elements comprises a beam spring, which biases the gripper element toward the radially extended position, the beam springs maintaining a bias on the gripper element after release of the sufficient pressure used to radially expand the expandable portion, and wherein the beam springs are oppositely arranged to act against the first and second inclined surfaces of the gripper element, locating the expandable portion in an existing tubular in a wellbore, introducing fluid pressure to an inner surface of the expandable portion and morphing the expandable portion towards the existing tubing so that the gripper element engages an inner surface of the existing tubing, reducing the fluid pressure, and maintaining engagement of the gripper element on the inner surface by action of the at least one beam spring axially on the gripper element.

A method of anchoring a morphable tubular in a wellbore according to one or more embodiments of the present disclosure includes providing a first tubular member including an expandable portion, the expandable portion having an anchoring system arranged around a circumference thereof, the anchoring system comprising: a gripper element having first and second oppositely arranged inclined surfaces, first and second wedge elements having third and fourth inclined surfaces oriented to engage the first and second oppositely arranged inclined surfaces, respectively, to move the gripper element to a radially extended position as the third and fourth inclined surfaces are moved against the first and second oppositely arranged inclined surfaces, wherein a least one of the wedge elements comprises a spring member that biases the gripper element toward the radially extended position, the spring member maintaining a bias on the gripper element after release of the sufficient pressure used to radially expand the expandable portion, and wherein the spring member has a first end affixed to the tubular member and a second end including an inclined surface that is free to move axially along the surface of the expanded portion, locating the expandable portion in an existing tubular in a wellbore, introducing fluid pressure to an inner surface of the expandable portion and morphing the expandable portion towards the existing tubing so that the gripper element engages an inner surface of the existing tubing, reducing the fluid pressure, and maintaining engagement of the gripper element on the inner surface by action of the at least one spring member axially on the gripper element.

One or more embodiments of the present disclosure provide an apparatus for anchoring a morphable tubular in a wellbore.

According to one or more embodiments of the present disclosure, an apparatus for anchoring a morphable tubular in a wellbore includes a tubular member including an expandable portion; the expandable portion having an anchoring system arranged around a circumference thereof; the anchoring system comprising: a gripper element having first and second oppositely arranged inclined surfaces; first and second wedge elements having third and fourth inclined surfaces respectively arranged on either side of the gripper element; wherein at least one of the wedge elements is a beam spring and the anchoring system is configured to maintain the gripper element in a radially extended position by action of the at least one beam spring following morphing of the expandable portion.

In this way, the tubular member is anchored to an existing tubular member, and the engagement is maintained after the expandable portion relaxes following morphing.

According to one or more embodiments of the present disclosure, the at least one beam spring is an annular beam spring. As a beam spring acts only in an axial direction, in contrast to the radially action of a bow spring, the annular beam spring advantageously acts uniformly around the circumference of the tubular member.

According to one or more embodiments of the present disclosure, the gripper element comprises one or more sections, the one or more sections being arranged circumferentially around the expandable portion and having an outer surface including at least a portion adapted to grip. Advantageously, the gripper element comprises one section being a substantially annular member. The outer surface may comprise a plurality of circumferential ridges, the ridges providing a spike or tooth tip for gripping the inner surface of the existing casing. Other gripping arrangements, as are known in the art, may be applied to the surface of the gripper element.

According to one or more embodiments of the present disclosure, the at least one beam spring includes at least one axially arranged spring snap section, the spring snap section being configured to create a split in the annular beam spring under radial expansion during morphing. Thus, the at least one beam spring will not restrict the radial expansion of the tubular member during morphing.

According to one or more embodiments of the present disclosure, the substantially annular member of the gripper element includes at least one axially arranged gripper snap section, the gripper snap section being configured to create a split in the gripper element under radial expansion during morphing. Thus, the gripper element will not restrict the radial expansion of the tubular member during morphing.

According to one or more embodiments of the present disclosure, the spring snap section and the gripper snap section are misaligned with respect to each other. This prevents the creation of a weak section along the anchoring system.

According to one or more embodiments of the present disclosure, the at least one beam spring has a first end affixed to the tubular member and a second end including the inclined surface which is free to move axially along the surface of the expanded portion. In this way, the spring may be pre-loaded to increase axial movement available following morphing.

According to one or more embodiments of the present disclosure, the first and second wedge elements are beam springs, the beam springs being oppositely arranged to act against the first and second inclined surfaces of the gripper element. In this way, the gripper element is evenly radially expanded and held in position.

According to one or more embodiments of the present disclosure, there are a plurality of anchoring systems arranged along the expandable portion. In this way, multiple annular anchoring points are provided to support the tubular member.

According to one or more embodiments of the present disclosure, in a first configuration, the at least one beam spring has an outer diameter substantially equal to an outer diameter of the gripper element and, in a second configuration following morphing, the outer diameter of the at least one beam spring is less than the outer diameter of the gripper element. This arrangement provides entry into narrow tubulars without a concern of sticking. Additionally, by having the gripper element separate from the spring, each can be made from the most appropriate material without the compromises of a dual-purpose material.

According to one or more embodiments of the present disclosure, a method of anchoring a morphable tubular in a wellbore includes providing a first tubular member including an expandable portion, the expandable portion having an anchoring system according to one or more embodiments of the present disclosure, locating the expandable portion in an existing tubular in a wellbore, introducing fluid pressure to an inner surface of the expandable portion and morphing the expandable portion towards the existing tubing so that the gripper element engages an inner surface of the existing tubing, reducing the fluid pressure, and maintaining engagement of the gripper on the inner surface by action of the at least one beam spring axially on the gripper element.

In this way, a tubular is anchored to an existing tubular using the benefits of morphing under fluid pressure. As morphing provides uniform radial expansion over the entire expansion portion, the wedge and gripper arrangement will work equally well following morphing in contrast to an expansion system based on passing a cone through the tubular member.

According to one or more embodiments of the present disclosure, the method includes the step of splitting a spring snap section and a gripper snap section during morphing. In this way, the presence of the gripper element and spring does not affect the morphing process.

In the method according to one or more embodiments of the present disclosure, maintaining engagement of the gripper on the inner surface is by opposing action of the first and second beam springs axially on the gripper element. The dual action provides uniform radial expansion and continued gripping of the gripper element with the inner surface of the existing casing.

Other aspects of the disclosure will be apparent from the following description and the appended claims.

BRIEF DESCRIPTION OF DRAWINGS

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results. Accordingly, the drawings and descriptions are to be regarded as illustrative in nature, and not as restrictive.

Certain embodiments of the disclosure will hereafter be described with reference to the accompanying drawings. It should be understood, however, that the accompanying drawings illustrate the various implementations described herein and are not meant to limit the scope of various technologies described herein. The drawings show and describe various embodiments of the current disclosure.

Figure 1:
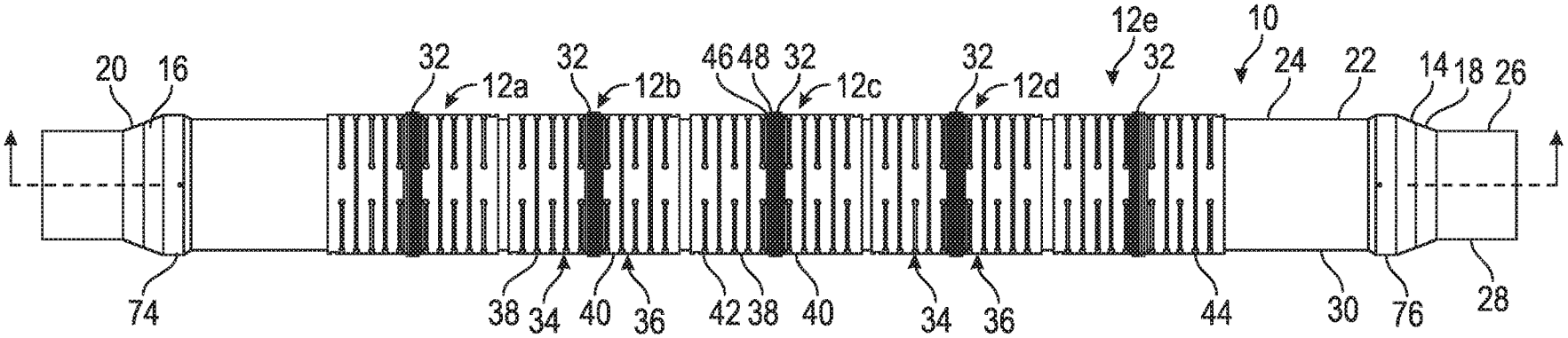
Figure 2:
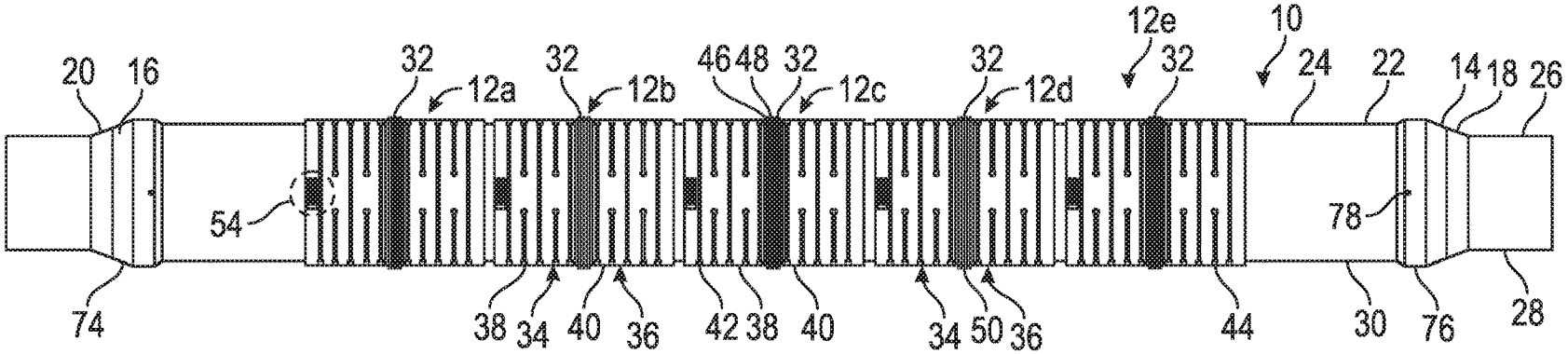
Figure 3:
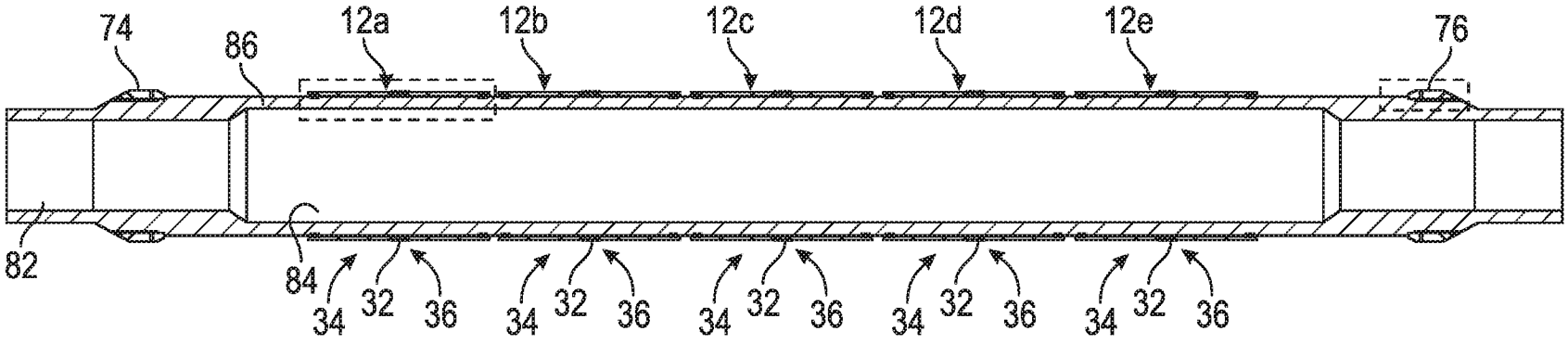
Figure 4:
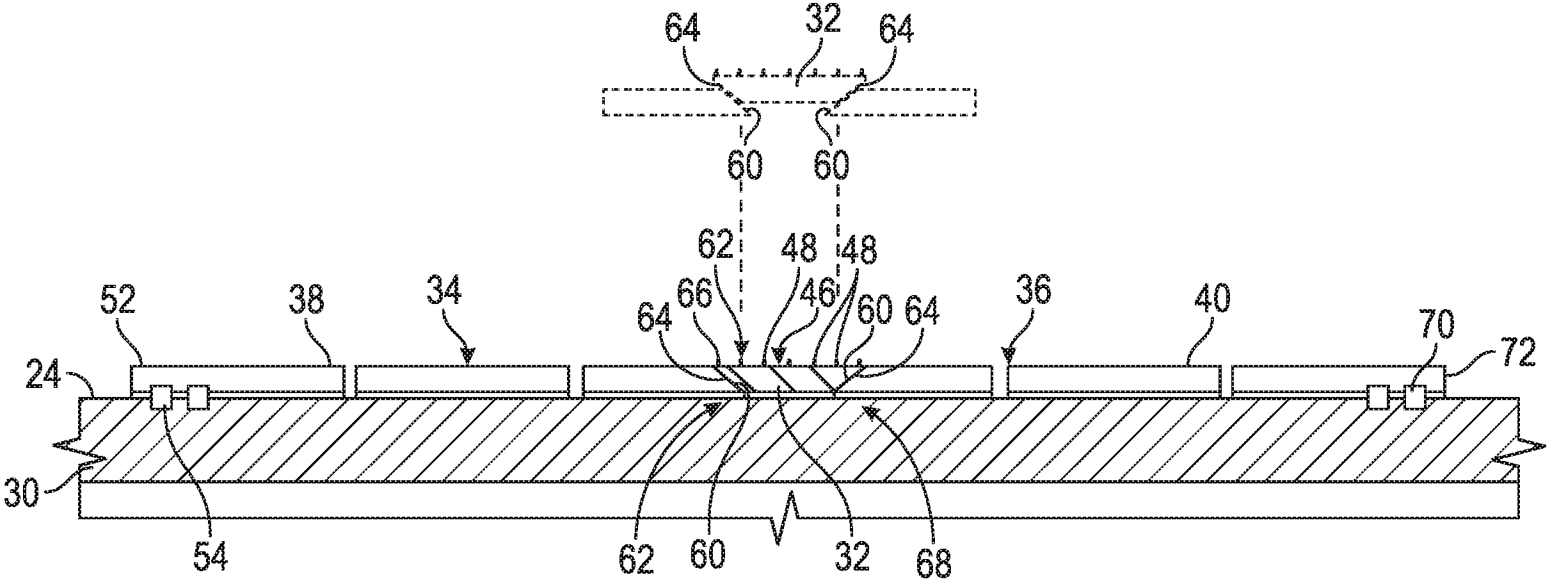
Figure 5:
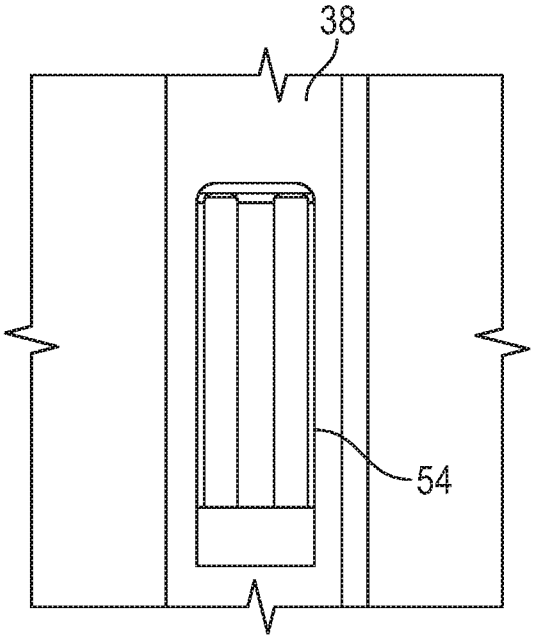
Figure 6:
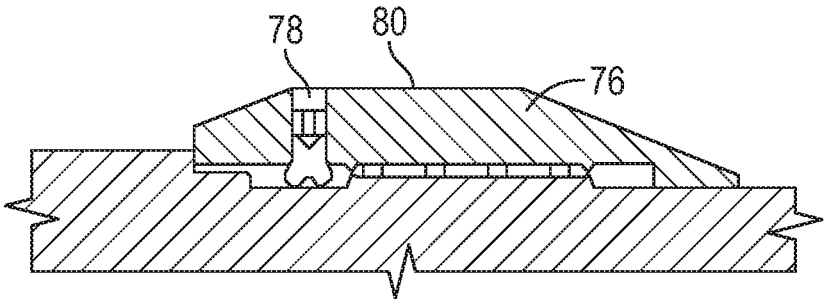
Figure 7:
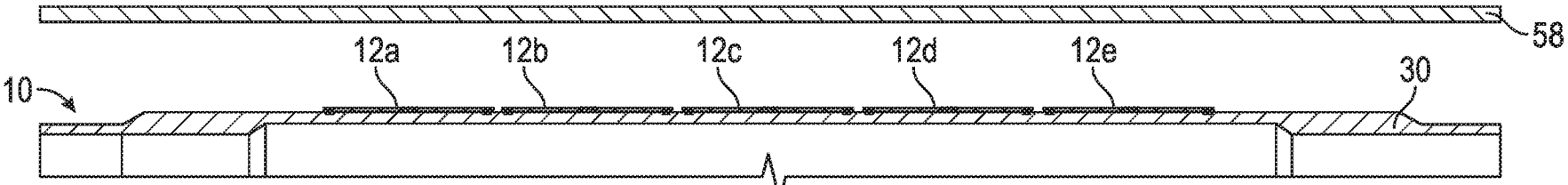
Figure 8:
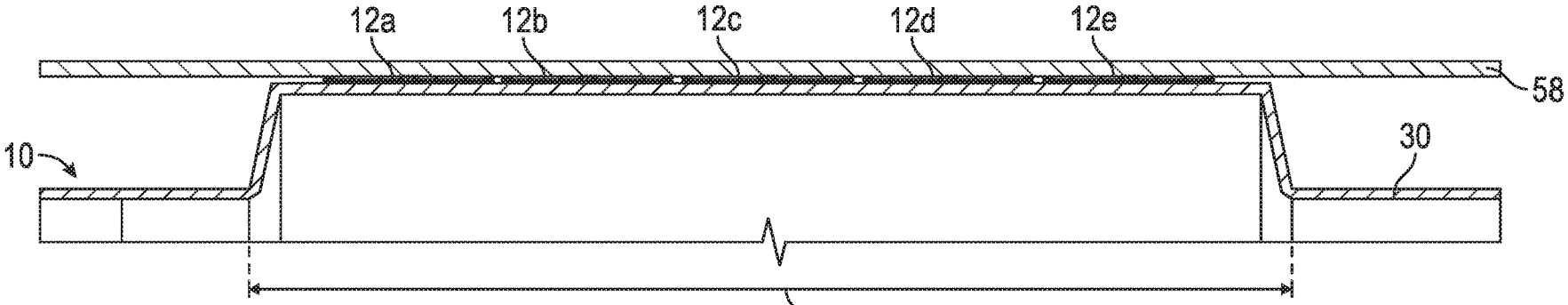
Figure 9:
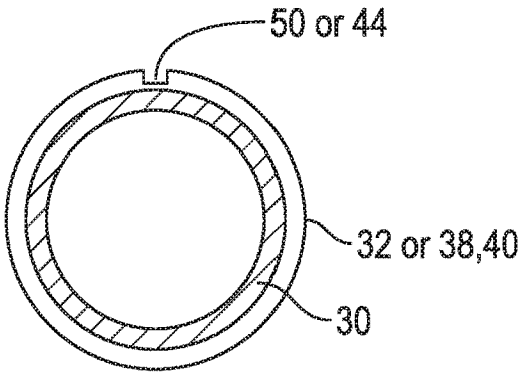

One or more embodiments of the present disclosure will now be described, by way of example only, with reference to the accompanying drawings of which:

FIG. 1 is a schematic illustration of a morphable anchor according to an embodiment of the present invention;

FIG. 2 is a further schematic illustration of the morphable anchor of FIG. 1;

FIG. 3 is a cross-sectional view through the morphable anchor of FIG. 1;

FIG. 4 is a part cross-sectional view through an anchoring system of the morphable anchor of FIG. 1;

FIG. 5 is an expanded view of a portion of the morphable anchor of FIG. 2;

FIG. 6 is an expanded view of a portion of the morphable anchor of FIG. 3;

FIG. 7 is a cross-sectional view of a portion of the morphable anchor in an unexpanded state according to one or more embodiments of the present disclosure;

FIG. 8 is a cross-sectional view of a portion of the morphable anchor in an expanded state according to one or more embodiments of the present disclosure; and FIG. 9 is a radial cross-sectional view of the morphable anchor according to an embodiment of the present invention.

DETAILED DESCRIPTION

Specific embodiments will now be described in detail with reference to the accompanying figures. Numerous details are set forth to provide an understanding of the present disclosure. However, it will be understood by those skilled in the art that the embodiments of the present disclosure may be practiced without these details and that numerous variations or modifications from the described embodiments may be possible.

The terminology and phraseology used in the specification and appended claims is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. All positional terms such as 'up' and 'down', 'left' and 'right' are relative and apply equally in opposite and in any direction.

Reference is initially made to FIGS. 1 to 3 of the drawings which illustrate a tubular member, generally indicated by reference numeral 10, including an anchoring system 12, according to an embodiment of the present invention.

Tubular member 10 is a standard hollow cylindrical tubing which may be liner, casing or any other tubular member which would form part of a string deployed in a wellbore as known in the oil and gas industry. At a first or upper end 14 and a second, lower, end 16 the tubular 10 has raised portions 18,20 respectively, to provide an inner body 30 with an outer diameter 22 of an outer surface 24 which is greater than the diameter 26 of an outer surface 28 at the ends 14,16 of the tubular member 10.

Mounted upon the outer surface 24 are anchoring systems 12 *a-e*. In the embodiment shown there are five anchoring systems 12 *a-e* located along the body 30 of the tubular member 10. Each anchoring system 12 *a-e* is identical and while the following description is to a single anchoring system 12, this extends to all the anchoring systems 12 *a-e*.

Anchoring system 12 comprises a central gripping element 32 located between a first wedge element 34 and a second wedge element 36. In a preferred embodiment each wedge element 34, 36 is a beam spring 38, 40 respectively. In an alternative embodiment the first wedge element is a stop. The first and second beam springs 38, 40 are arranged to be oppositely opposed, and thus will act towards each other and onto the gripper element 32 located therebetween.

Referring now to FIGS. 1, 2, and 9, each beam spring 38, 40 is an annular beam spring and thus is arranged circumferentially around the outer surface 24 of the body 30. Beam springs 38, 40 may also be referred to as leaf springs or flat springs as are known in the art. Each beam spring 38, 40 has annularly arranged cut-aways 42 which allow the spring 38, 40 to expand or be compressed along the longitudinal axis A of the tubular member 10. Thus, the springs 38, 40 move axially over the surface 24 of the tubular 10 to act upon the gripper element 32. Also, on each spring is a snap section 44, which provides a perforated line through the spring in the axial direction. Perforating the spring along a snap section provides a weakened line in the spring that does not act in the direction of the spring action but transverse to the axial direction. Radial expansion of the springs 38, 40 will therefore apply pressure across the snap section 44 and cause it to snap at the perforation. This will not affect the action of the springs 38, 40 as it will merely increase the diameter of each spring 38, 40.

Still referring to FIGS. 1, 2, and 9, like the beam springs 38, 40, the gripper element 32 is formed as an annular ring which sits around the circumference of the outer surface 24 of the body 30 of the tubular member 10. Gripper element 32 is substantially an annular metal band of hardened material. The outer face 46 of the gripper element 32 is profiled to provide a gripping surface 48. In the embodiment shown the gripping surface 48 is formed by ridges machined circumferentially around the outer surface 46 of element 32 to provide toothed tips for engaging and holding on an inner surface of an existing tubular (not shown). While the gripper element 32 is shown as a single annular ring it may be constructed as two or more arc portions of a circle which combine to form the gripper element 32. Gripper element 32 is also provided with a snap section 50. Snap section 50 serves the same purpose as the snap section 44 of the beam springs 38, 40.

Anchoring system 12 is assembled on the tubular member 10 by locating the first beam spring 38 over the outer surface 24 of the body 30. A first end 52 of the beam spring 38 is attached to the outer surface 24 of the body 30 so as to be fixed relative to tubular member 10. This arrangement is best seen in FIGS. 4 and 5 where the fixings 54 are recessed so as not to protrude above the outer surface 56 of the spring 38. A second, opposite end, of the spring 38 has an inclined surface 38 providing the wedge feature of the wedge element 34. Gripper element 32 has a first side 62 with a matching inclined surface 64. The inclined surfaces 60, 64 are aligned and a fixing used to prevent relative rotation of the gripper element 32 to the spring 38. The fixing 66 is positioned such that the spring snap section 44 and gripper snap section 50 are rotationally misaligned so that the weak point profile line provided at the snap sections is not co-linear preventing a continuous axial weak line through the anchoring system 12. The second side 68 of the gripper element 32 is identically arranged to the first 62 with the spring 40 being oppositely arranged to the spring 40. The springs 38, 40 and gripper element 32 may be axially compressed against the fixings 54 to pre-load the system. Fixings 70 at the second end 72 of the beam spring 40 can then be affixed to the outer surface 24 in a similar manner to the fixings 54, as shown in FIG. 4.

The anchoring systems 12 *a-e* are spaced apart along the outer surface 24 of the body 30. The preferred embodiment has five anchoring systems 12, though the number can be variable to suit the load requirements of the apparatus. At each end of the body 30 gauge rings 74, 76 are fixed via fixings 78 to the outer surface 24 of the body 30. The gauge rings 74, 76 provide an outer surface 80 having an outer diameter which is greater than the initial outer diameters of the springs 38, 40 and gripper element 32 when the anchor systems 12 *a-e* are assembled. This ensures that the anchor elements are not damaged during run in.

In use, the tubular member 10 including the anchoring systems 12 *a-e* is conveyed into the wellbore by any suitable means, such as incorporating the member 10 into a casing or liner string and running the string into the wellbore until it reaches the location within a tubular or a portion of the wellbore at which the tubular member 10 is to be anchored. The string may include further tools such as a morphable portion to act as a liner hanger.

Each anchor system 12 is set by increasing the pump pressure in the throughbore 82 of the tubular member 10. Fluid pressure against the inner surface 84 of the tubular member 10 will cause the wall 86 of the body 30 to move radially outwards by elastic expansion. This will continue until the surface 24 is morphed to the inner surface of the tubular in which the anchor system 12 is inserted, by plastic deformation. During the expansion, the springs 38, 40 and gripper element 32 will also be forced radially outwards. Depending upon the materials chosen for the springs 38, 40 and gripper element 32, these may elastically deform. Specifically, FIGS. 7 and 8 provide cross-sectional views of a portion of the morphable anchor in an unexpanded state and an expanded state, respectively. Alternatively, if the materials do not expand then sufficient pressure will be applied to cause the snap sections 44, 50 to break apart and so provide an opening in each for expansion.

As the body 30 is morphed, the ridges on the gripping surface 48 of the gripper element 32 will bite into the tubular 58 in which the anchor system 12 is inserted (FIG. 8). The outer surface 24 will take up a fixed shape under plastic deformation with the surface 24 matching the profile of the surface of the wellbore or tubular it is located within. Morphing will have effectively centered, secured and anchored the tubular member 10 to the wellbore or other tubular.

When the pressure is released, the body 30 may elastically relax causing a slight contraction. This contraction improves the metal to metal seal between the tubulars as the outer tubular, which will have expanded through elastic deformation during the morphing will return to its original size and more firmly seal against the now plastically deformed tubular member 10. However, there is a chance that the tubular member 10 may also relax causing the tubular member 10 to want to come away from the inner surface of the outer tubular. This risks loosening any anchoring between the two tubulars and consequently lowering the load bearing capacity of the anchor systems 12. However, during morphing the body 30 will have contracted axially and the already preloaded beam springs 38, 40 will act axially against the gripping member 32. The wedge action on the inclined surfaces 60, 64 at either side 62, 68 of the gripper element 32 will force the gripper element 32 radially outwards and retain the ridges and gripping action on the outer tubular. Even when the body 30 relaxes the axially arranged action of the beam springs 38, 40 via the inclined surfaces will give a greater radial movement, to force the gripper element 32 outwards, than the inward radial movement caused by the relaxation of the tubular member 10. This will ensure contact is maintained to anchor the gripper element 32 to the inner surface of the outer tubular.

Pressure in the throughbore 82 can be increased by sealing or plugging the throughbore at a position below the first end 52 of the beam spring 38 on the lowermost anchor system 12 *a*, and increasing pump pressure from surface.

An alternative method is by use of a hydraulic fluid delivery tool. Once the string reaches its intended location, the tool can be run into the string from surface by means of a coiled tubing or other suitable method. The tool is provided with upper and lower seal means, which are operable to radially expand to seal against the inner surface 84 of the body 30 at a pair of spaced apart locations in order to isolate an internal portion of body 30 located between the seals 92; it should be noted that said isolated portion includes at least one anchoring system 12. The tool is also provided with an aperture in fluid communication with the interior of the string.

To operate the tool, seal means are actuated from the surface to isolate the portion of the body 30. Fluid, which is preferably hydraulic fluid, is then pumped under pressure, through the coiled tubing such that the pressurized fluid flows through tool aperture into the throughbore 82 and acts in the same manner as described hereinbefore.

A detailed description of the operation of such a hydraulic fluid delivery tool is described in GB2398312 in relation to the packer tool 112 shown in FIG. 27 with suitable modifications thereto, where the seal means could be provided by suitably modified seal assemblies 214, 215 of GB2398312, the disclosure of which is incorporated herein by reference. The entire disclosure of GB2398312 is incorporated herein by reference. Accordingly, the body 30 has been plastically deformed and morphed by fluid pressure without any mechanical expansion means being required.

If desired the tubular member 10 and anchor system 12 may be run on the tool by using the sealing means to support the tubular member 10 and anchor system 12 during run-in.

The principle advantage of the present invention is that it provides apparatus and method of anchoring a tubular in a wellbore which maintains the anchoring and thus increases the load bearing capacity following morphing.

A further advantage of at least one embodiment of the present invention is that it provides apparatus and method of anchoring a tubular in a wellbore which uses fluid pressure to operate the anchor giving uniform radial expansion over the length of the anchor system simultaneously.

It will be appreciated by those skilled in the art that various modifications may be made to the invention herein described without departing from the scope thereof. For example, the anchoring system could be incorporated with a morphable liner hanger. The ends of the springs may be arranged against stops rather than being directly affixed to the tubular member. Each anchoring system could directly abut an adjacent anchoring system. The beam springs could be linear beam springs arranged axially on the surface and spaced apart around the circumference thereof.

What is claimed is:

1. A method of anchoring a morphable tubular in a wellbore, comprising:

providing a first tubular member including an expandable portion, the expandable portion having an anchoring system arranged around a circumference thereof, the anchoring system comprising:

a gripper element having first and second oppositely arranged inclined surfaces;

first and second wedge elements having third and fourth inclined surfaces oriented to engage the first and second oppositely arranged inclined surfaces, respectively, to move the gripper element to a radially extended position as the third and fourth inclined surfaces are moved against the first and second oppositely arranged inclined surfaces, wherein each of the first and second wedge elements comprises a beam spring, which biases the gripper element toward the radially extended position, the beam springs maintaining a bias on the gripper element after release of the sufficient pressure used to radially expand the expandable portion, and wherein the beam springs are oppositely arranged to act against the first and second inclined surfaces of the gripper element;

locating the expandable portion in an existing tubular in a wellbore;

introducing fluid pressure to an inner surface of the expandable portion and morphing the expandable portion towards the existing tubing so that the gripper element engages an inner surface of the existing tubing;

reducing the fluid pressure; and maintaining engagement of the gripper element on the inner surface by action of the at least one beam spring axially on the gripper element.

2. The method according to claim 1, wherein the maintaining step further comprises maintaining engagement of the gripper element on the inner surface by opposing action of the beam springs axially on the gripper element.

3. The method according to claim 1, wherein the beam spring is annular.

4. The method according to claim 3, wherein each beam spring further comprises a spring snap section, and the method further comprising splitting the spring snap section during morphing the expandable portion towards the existing tubing.

5. The method according to claim 4, wherein the gripper element further comprises a gripper snap section, the method further comprising splitting the gripper snap section during morphing the expandable portion towards the existing tubing.

6. The method according to claim 5, wherein the spring snap section and the gripper snap section are misaligned with respect to each other.

7. The method according to claim 1, wherein the gripper element comprises one or more sections, the one or more sections being arranged circumferentially around the expandable portion and having an outer surface including at least a portion adapted to grip.

8. The method according to claim 7, wherein the gripper element comprises one section being a substantially annular member.

9. The method according to claim 1, wherein, in a first configuration before the morphing step, the beam spring has an outer diameter substantially equal to an outer diameter of the gripper element and, wherein, in a second configuration following the morphing step, the outer diameter of the beam spring is less than the outer diameter of the gripper element.

10. The method according to claim 1, wherein the beam spring has a first end affixed to the tubular member and a second end including the inclined surface, which is free to move axially along the surface of the expanded portion.

11. A method of anchoring a morphable tubular in a wellbore, comprising:

providing a first tubular member including an expandable portion, the expandable portion having an anchoring system arranged around a circumference thereof, the anchoring system comprising:

a gripper element having first and second oppositely arranged inclined surfaces;

first and second wedge elements having third and fourth inclined surfaces oriented to engage the first and second oppositely arranged inclined surfaces, respectively, to move the gripper element to a radially extended position as the third and fourth inclined surfaces are moved against the first and second oppositely arranged inclined surfaces, wherein at least one of the wedge elements comprises a spring member that biases the gripper element toward the radially extended position, the spring member maintaining a bias on the gripper element after release of the sufficient pressure used to radially expand the expandable portion, and wherein the spring member has a first end affixed to the tubular member and a second end including an inclined surface that is free to move axially along the surface of the expanded portion;

locating the expandable portion in an existing tubular in a wellbore;

introducing fluid pressure to an inner surface of the expandable portion and morphing the expandable portion towards the existing tubing so that the gripper element engages an inner surface of the existing tubing;

reducing the fluid pressure; and maintaining engagement of the gripper element on the inner surface by action of the at least one spring member axially on the gripper element.

* * * * *